US008418276B2

(12) United States Patent
Huang

(10) Patent No.: US 8,418,276 B2
(45) Date of Patent: Apr. 16, 2013

(54) TOILET FLUSHING DEVICE

(76) Inventor: So-Mei Huang, Tai Ping (TW)

( * ) Notice: Subject to any disclaimer, the term of this patent is extended or adjusted under 35 U.S.C. 154(b) by 253 days.

(21) Appl. No.: 13/064,278

(22) Filed: Mar. 16, 2011

(65) Prior Publication Data

US 2012/0233760 A1 Sep. 20, 2012

(51) Int. Cl.
*A47K 3/022* (2006.01)

(52) U.S. Cl.
USPC ..... 4/405

(58) Field of Classification Search ..... 4/405, 412, 4/413, 414, 324–326
See application file for complete search history.

(56) References Cited

U.S. PATENT DOCUMENTS 3,091,775 A * 6/1963 Himmelrick ..... 4/325
4,058,858 A * 11/1977 Che-Wei ..... 4/324
5,319,809 A * 6/1994 Testa ..... 4/325
7,140,050 B2 * 11/2006 Muderlak ..... 4/405
2004/0154087 A1 * 8/2004 Hogues, Jr. ..... 4/405
2005/0076425 A1 * 4/2005 Contadini ..... 4/405
2005/0217014 A1 * 10/2005 Hung et al. ..... 4/405
2008/0276360 A1 * 11/2008 Yang ..... 4/405
2009/0235444 A1 * 9/2009 Hogues, Jr. ..... 4/405
2010/0050331 A1 * 3/2010 Sim ..... 4/324

* cited by examiner

*Primary Examiner* — Gregory L. Huson
*Assistant Examiner* — Janie Christiansen
(74) *Attorney, Agent, or Firm* — Guice Patents PLLC

(57) ABSTRACT

The present invention relates to a toilet flushing device including an outer casing, a gear set, a ring disk set, a connecting rod set and a drive set; wherein the drive set includes a toilet flushing handle. By pressing or lifting the toilet flushing handle towards different directions, the discharged water amount can be controlled accurately and thereby achieves the goal of water saving.

6 Claims, 12 Drawing Sheets

TOILET FLUSHING DEVICE

BACKGROUND OF THE INVENTION

1. Field of the Invention

The present invention relates to a toilet flushing device, and more particularly to a dual-flush toilet device that is capable of controlling and saving water thereof with one toilet flushing handle and is commonly applicable to all kinds of toilet cisterns.

2. Brief Description of the Related Art

FIG. 1 illustrates the existing dual-flush toilet device, wherein a toilet flushing handle set 11 is disposed at lateral surface of a toilet cistern 10. The toilet flushing handle set 11 comprises a first toilet flushing handle 111 and a second toilet flushing handle 112, wherein the first toilet flushing handle 111 links up with a first connecting rod 113. One end of the first connecting rod 113 is attached to an end of a first chain 133, wherein the other end of the first chain 133 is attached to a lower valve body 122. The lower valve body 122 is disposed on top of a flush valve 120 of an overflow tube 12 and the front side thereof is connected to an auxiliary float body 123. The second toilet flushing handle 112 links up with a second connecting rod 114, wherein one end of the second connecting rod 114 is attached to an end of a second chain 132; and the other end of the second chain 132 is attached to an upper valve body 121 that is disposed on top of the lower valve body 122. The second chain 132 is further disposed of a small float ball 131. When flushing stool, press the first toilet flushing handle 111 to lift the lower valve body 122 and discharge water; since the auxiliary float body 123 positioned in front of the lower valve body 122 has a large volume, the time required for the lower valve body 122 to cover up the flush valve 120 is longer and the discharged water amount is therefore larger. When flushing urine, press the second toilet flushing handle 112 to lift the upper valve body 121 and discharge water; since the small float ball 131 is of small volume, the time required for the upper valve body 121 to cover up the lower valve body 122 is shorter and therefore the discharged water amount is smaller.

The foregoing prior arts of the dual-flush toilet device (hereinafter the prior arts) are of the following deficiencies:

1. The first and second connecting rods 113 and 114 of different kinds of toilet cisterns are of different pressing angles, therefore the repair parts are not commonly applicable. When the original model's production stops, it has to be replaced by a repair part of different model or different brand, and the water discharge amount is hence inaccurate.
2. The first and second connecting rods 113 and 114 are capable of controlling the water discharge amount; however, the using of the small float ball 131 and the auxiliary float body 123 of the prior art to control water discharge amount is actually not accurate due to the swaying movement of the small float ball 131 and the auxiliary float body 123 caused by the water flow in the toilet cistern 10.

SUMMARY OF THE INVENTION

In order to overcome the deficiencies of the prior art, a primary object of the present invention is to provide a dual-flush toilet device that is capable of controlling and saving water thereof with one toilet flushing handle and is commonly applicable to all kinds of toilet cisterns.

With the above object in mind, the dual-flush toilet device of the present invention comprises an outer casing, a gear set, a ring disk set, a connecting rod set and a drive set; wherein the drive set comprises a toilet flushing handle. By pressing or lifting the toilet flushing handle towards different directions, the discharged water amount can be controlled accurately and thereby achieves the goal of water saving.

The outer casing is disposed of a ventilation set comprising an air cell disposed in a first casing body thereof, a control valve, a connecting base and an air duct.

The drive set is comprised of a toilet flushing handle, a fixing axle cover, a drive rod, a cistern fixing nut and a fixing rotate screw.

The connecting rod set is comprised of a connecting rod head having a connecting rod, and a stop seat.

BRIEF DESCRIPTION OF THE INVENTION

The detail structure, the applied principle, the function and the effectiveness of the present invention can be more fully understood with reference to the following description and accompanying drawings, in which.

DETAILED DESCRIPTION OF THE PREFERRED EMBODIMENTS

Figure 1:
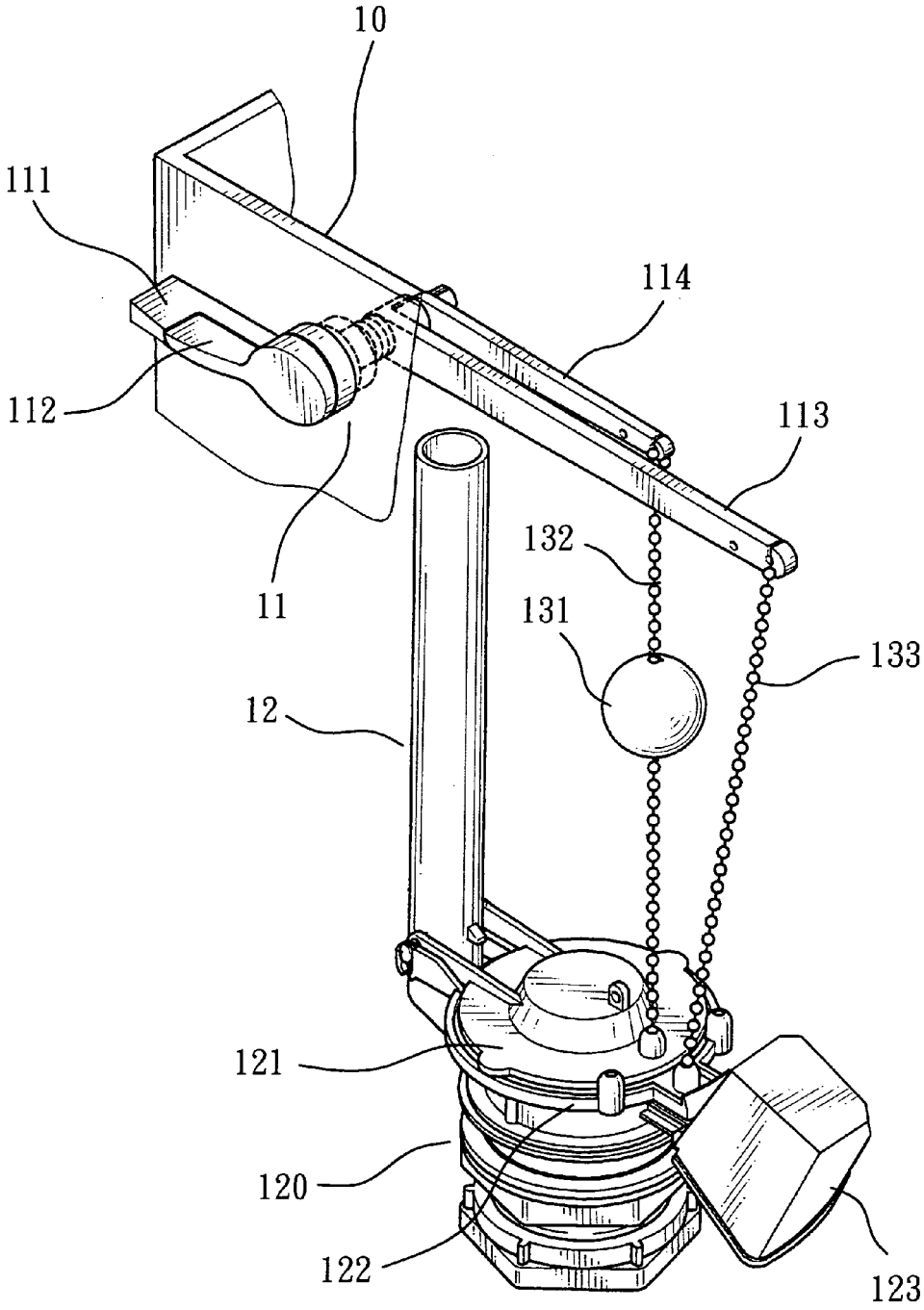
FIG. 1 PRIOR ART
FIG. 1 is a perspective view illustrating the prior art.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

Figure 2:
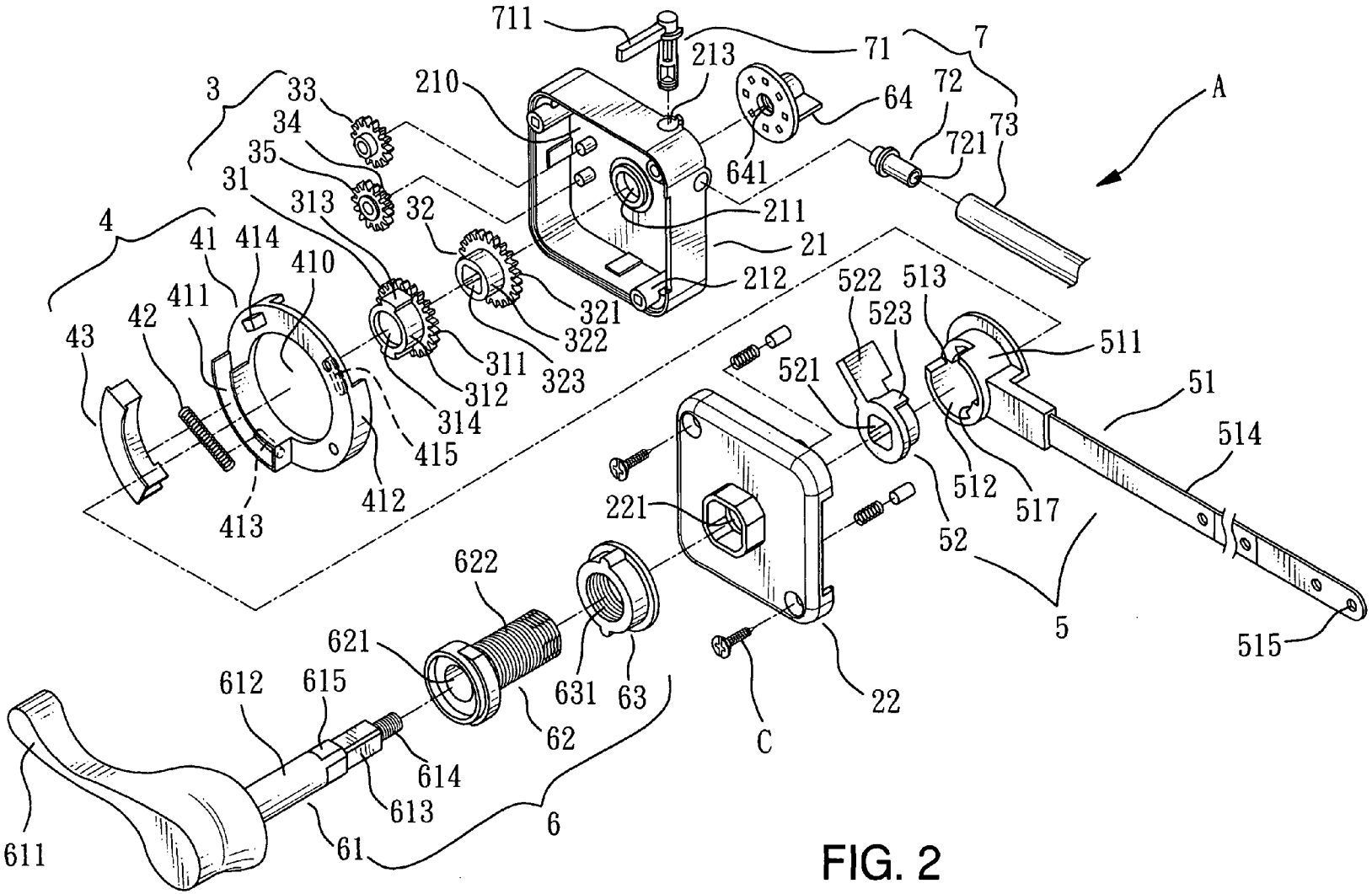
FIG. 2 is an exploded perspective view according to the present invention.
Figure 5:
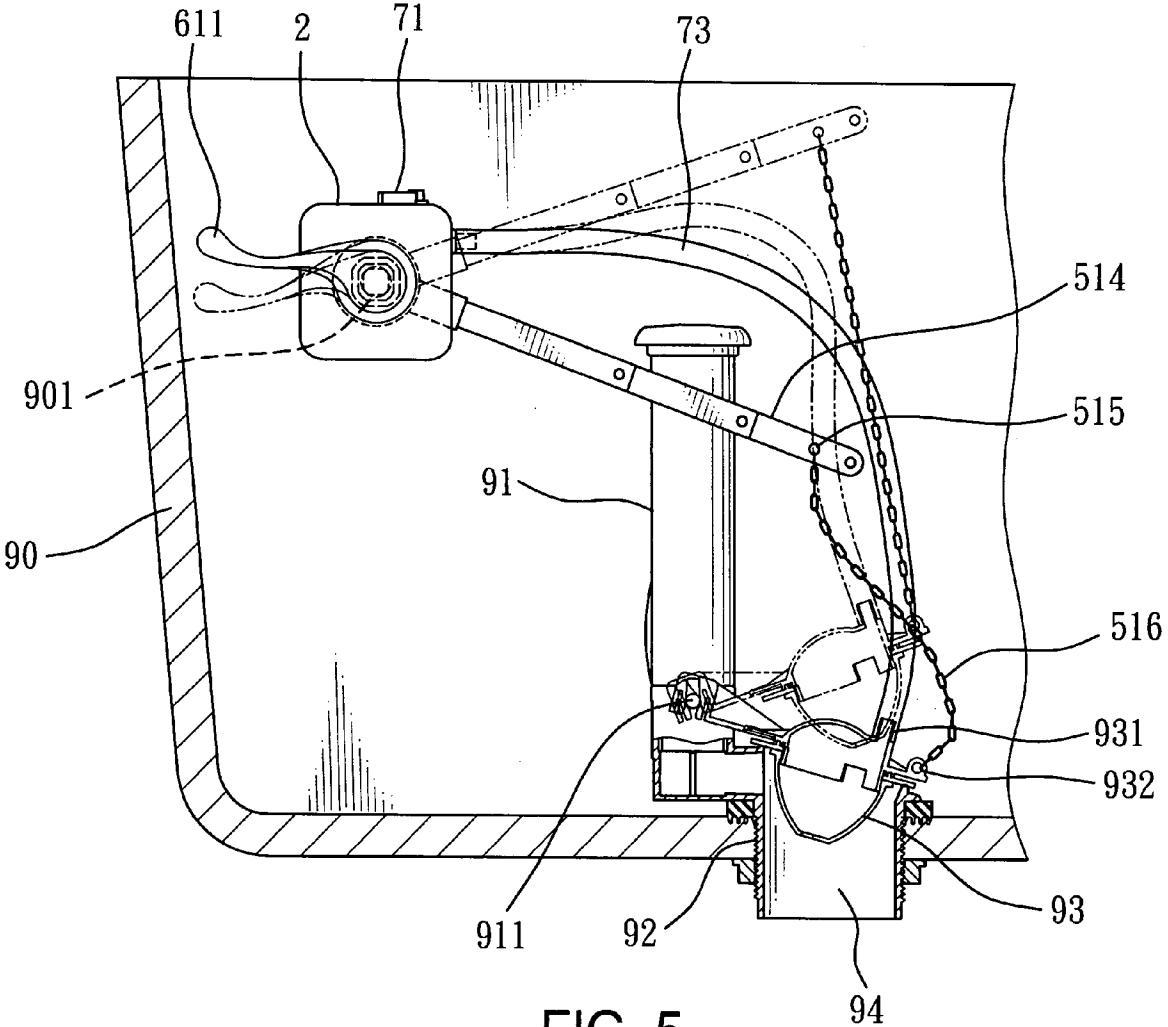
FIG. 5 illustrates an embodiment according to the present invention.

With reference to FIGS. 2 and 5, wherein the toilet flushing device A of the present invention comprises an outer casing 2, a gear set 3, a ring disk set 4, a connecting rod set 5 and a drive set 6.

Figure 3:
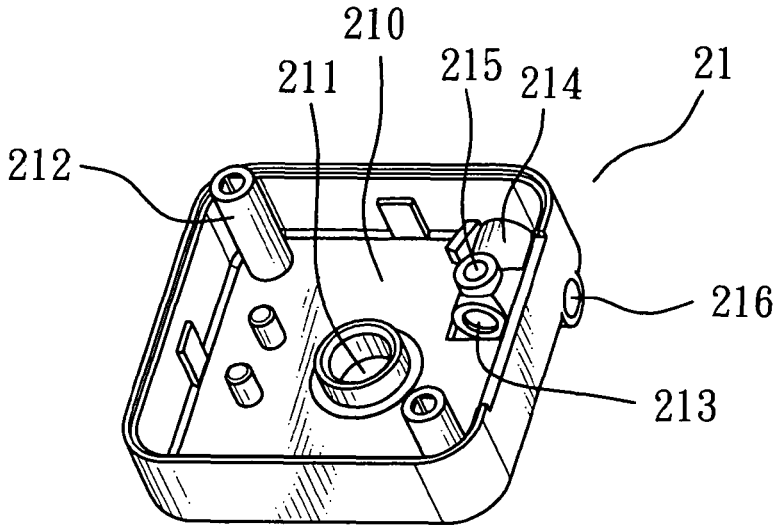
FIG. 3 is a perspective view of the first casing body according to the present invention.
Figure 4:
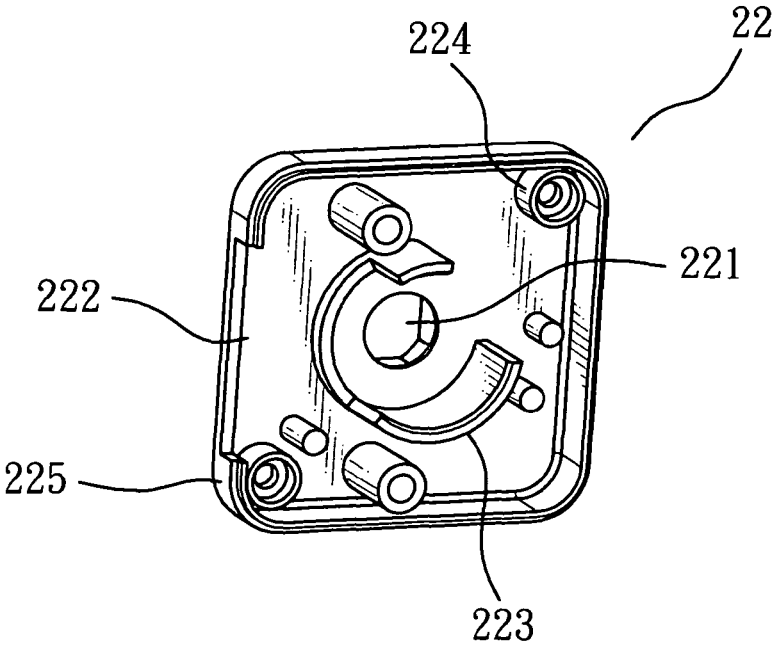
FIG. 4 is a perspective view of the second casing body according to the present invention.

Please refer to FIGS. 3 and 4, wherein the outer casing 2 is comprised of a first casing body 21 and a second casing body 22. The first casing body 21 has a receiving space 210, and a plurality of fixing studs 212 is disposed therein. A first axle hole 211 penetrates the center of the first casing body 21. The second casing body 22 is disposed of a second axle hole 221 and a plurality of fixing hole columns 224 at the inner surface thereof. At least one arc-shaped retaining wall 223 is disposed to surround peripheral edge of the second axle hole 221, and the fixing hole columns 224 correspondingly fit with the fixing studs 212 to allow a bolt C to screw lock thereon. One of the lateral surface 225 of the second casing body 22 is disposed of a notch 222.

The gear set 3 comprises:

a drive seat 31 having a seat body 312 and a first gear 311 disposed at the bottom thereof, wherein at least one third convex rib 313 is disposed at peripheral edge of the seat body 312, and a housing aperture 314 penetrates through center of the seat body 312;

a driven seat 32 having a seat body 322, wherein a second gear disposed at the bottom of the seat body 322 and a third axle hole 323 that is polygonal is disposed at the center of the seat body 322;

a third gear 33 meshing with the second gear 32;

a fourth gear 34 meshing with the third gear 33; and a fifth gear 35 coaxially linking up with the fourth gear 34 and meshing with the first gear 311 of the drive seat 31.

Figure 9:
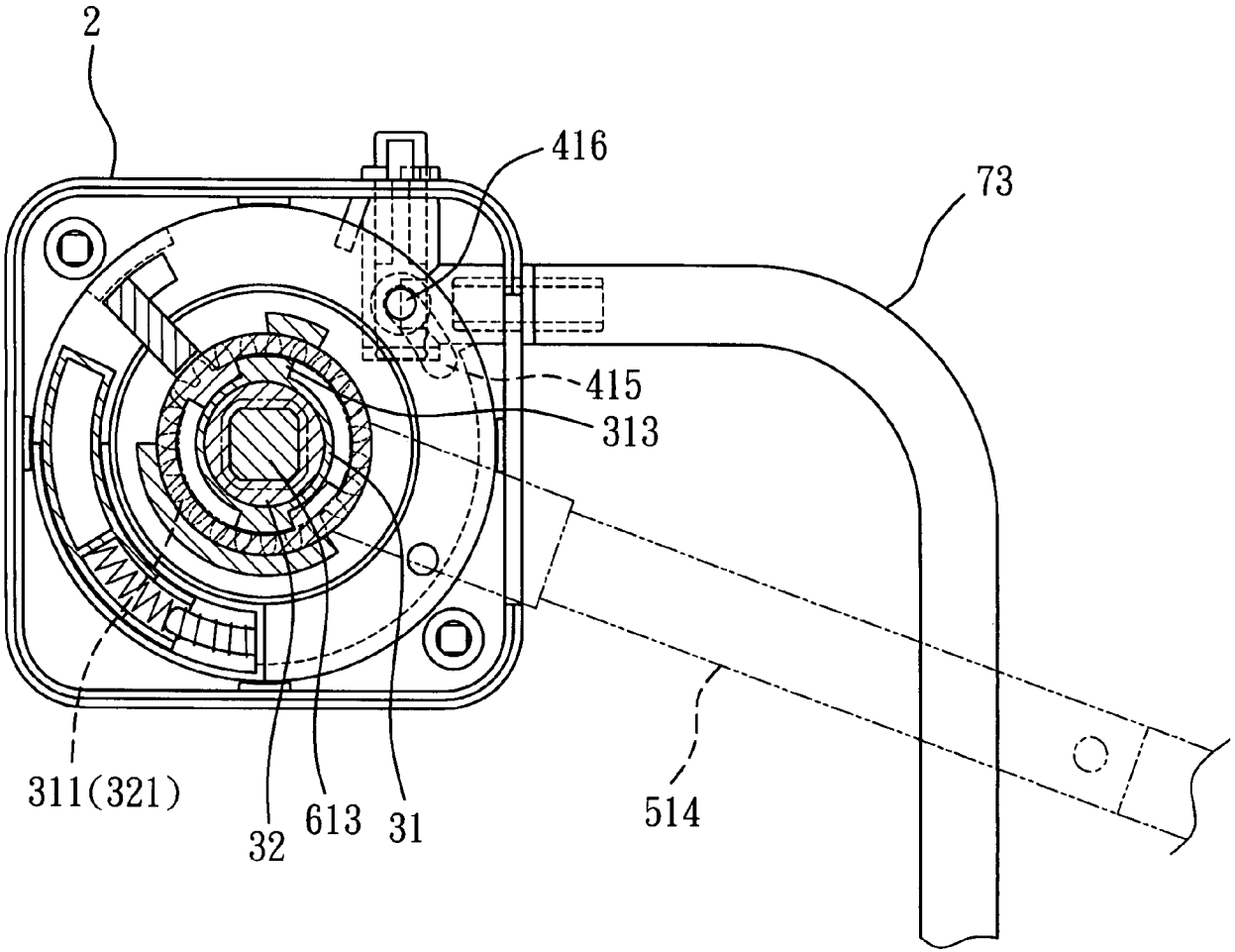
FIG. 9 is the first I-I sectional view according to the present invention.
Figure 10:
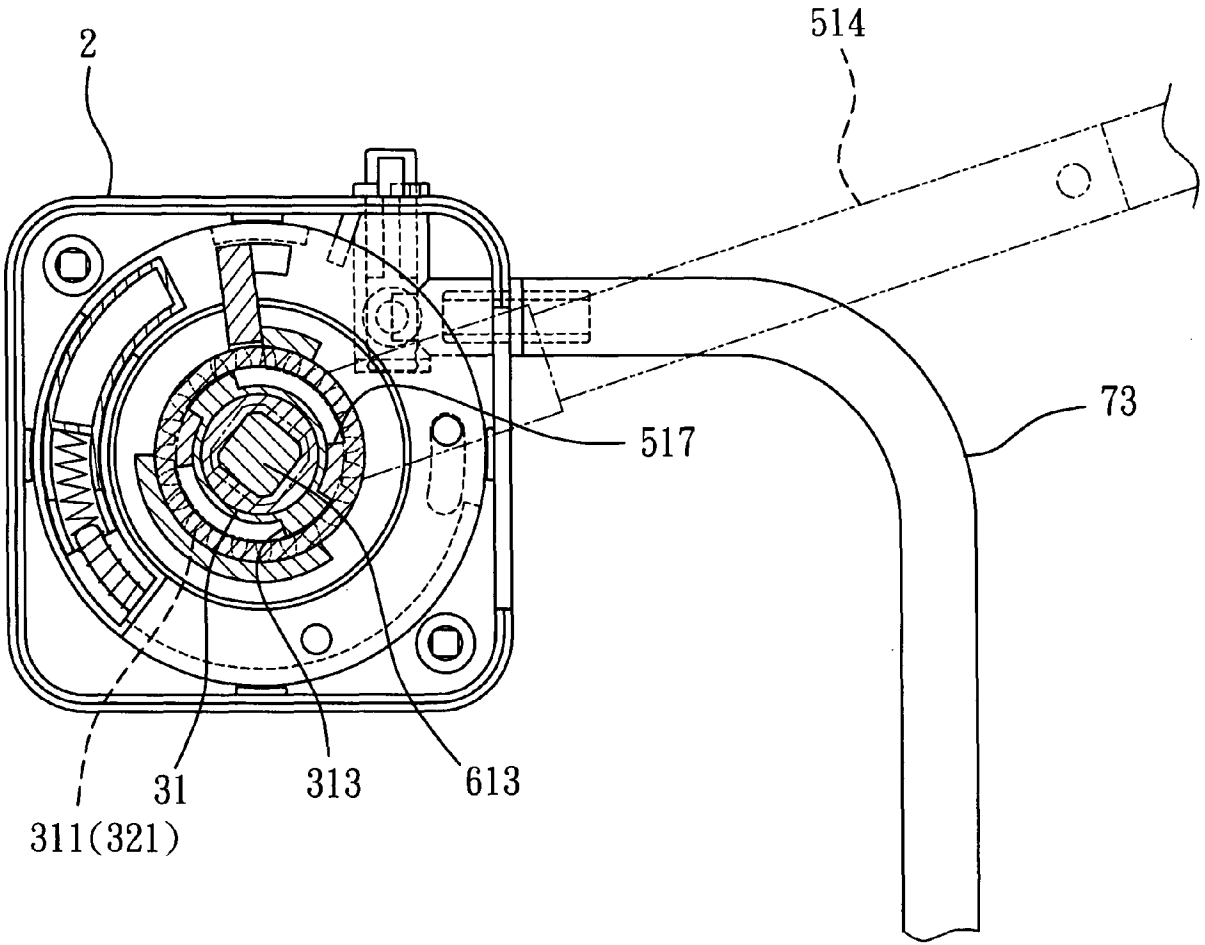
FIG. 10 is the second I-I sectional view according to the present invention.

The ring disk set 4 comprising:

a ring disk body 41 having a rounded hole 410, wherein a plurality of supporting pieces 412 are disposed along the periphery edge of the ring disk body 41 and an arc-shaped groove 415 is disposed at the bottom lateral surface of the ring disk body 41, with an air hole 416 disposed thereon, as illustrated in FIG. 9; further, an arc-shaped chamber 411 and a stop block 414 are provided at the top surface of the ring disk body 41, wherein a fixing column 413 is convexly disposed at one side of the arc-shaped chamber 411;

a spring 42 fitting with the fixing column 413; and an arc-shaped pushing seat 43 disposed inside the arc-shaped chamber 411 and being pushed by the spring 42.

The connecting rod set 5 comprising:

a connecting rod head 51 comprising a connecting rod 514 extends from the periphery edge of a rounded main body 511, wherein a plurality of hanging holes 515 is disposed at the connecting rod 514 to allow hanging of a chain 516 as illustrated in FIG. 5; the rounded main body 511 further comprises a fourth axle hole 512 and a notch 513, wherein at least one first convex rib 517 is disposed on the inner wall of the fourth axle hole 512;

a stop seat 52 having a polygon hole 521, wherein a stop piece 522 and at least one second convex rib 523 are disposed along the periphery edge of the stop seat 52.

The drive set 6 comprising:

a toilet flushing handle 61 having a handle body 611, wherein a rod body 612 extends from one side of the handle body 611, and a first joining section 615, a second joining section 613 and an external thread section 614 is disposed on the rod body 612;

a fixing axle cover 62 having an axle hole 621 penetrating the center thereof to allow insertion of the rod body 612, and peripheral edge of the fixing axle cover 62 provides an external thread section 622;

a cistern fixing nut 63 screw locked to the external thread section 622 of the fixing axle cover 62; and a fixing rotate screw 64 having an inner thread hole 641 to allow screw locking with the external thread section 614 of the rod body 612.

The outer casing 2 of the toilet flushing device A further comprises a ventilation set 7 as illustrated in FIGS. 2, 3 and 5. The ventilation set 7 comprises:

an air cell 214 disposed in the first casing body 21, wherein the air cell 214 has a valve hole 213 to receive a control valve 71, and is further disposed of a first through hole 215 and a second through hole 216 that are in connection to the valve hole 213;

the control valve 71 having a control handle 711 extending from the upper end thereof;

a connecting base 72 having a hollow through hole 721, wherein one end of the connecting base 72 fits with the second through hole 216 and the other end of the connecting base 72 fits with an end of an air duct 73; and the air duct 73, wherein the other end thereof is connected to an air connector 931 of a valve body 93 that covers a flush valve 92 as illustrated in FIG. 5.

Figure 6:
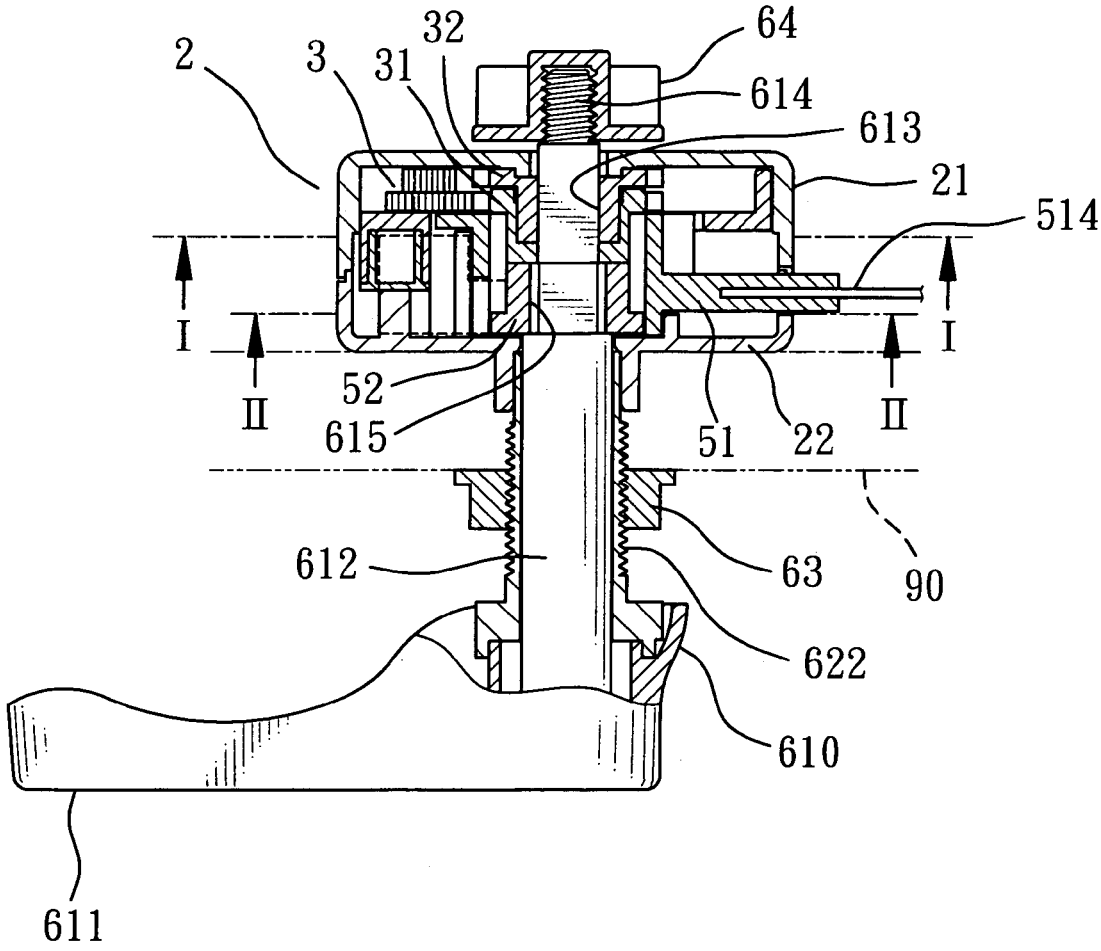
FIG. 6 is a sectional view according to the present invention.
Figure 7:
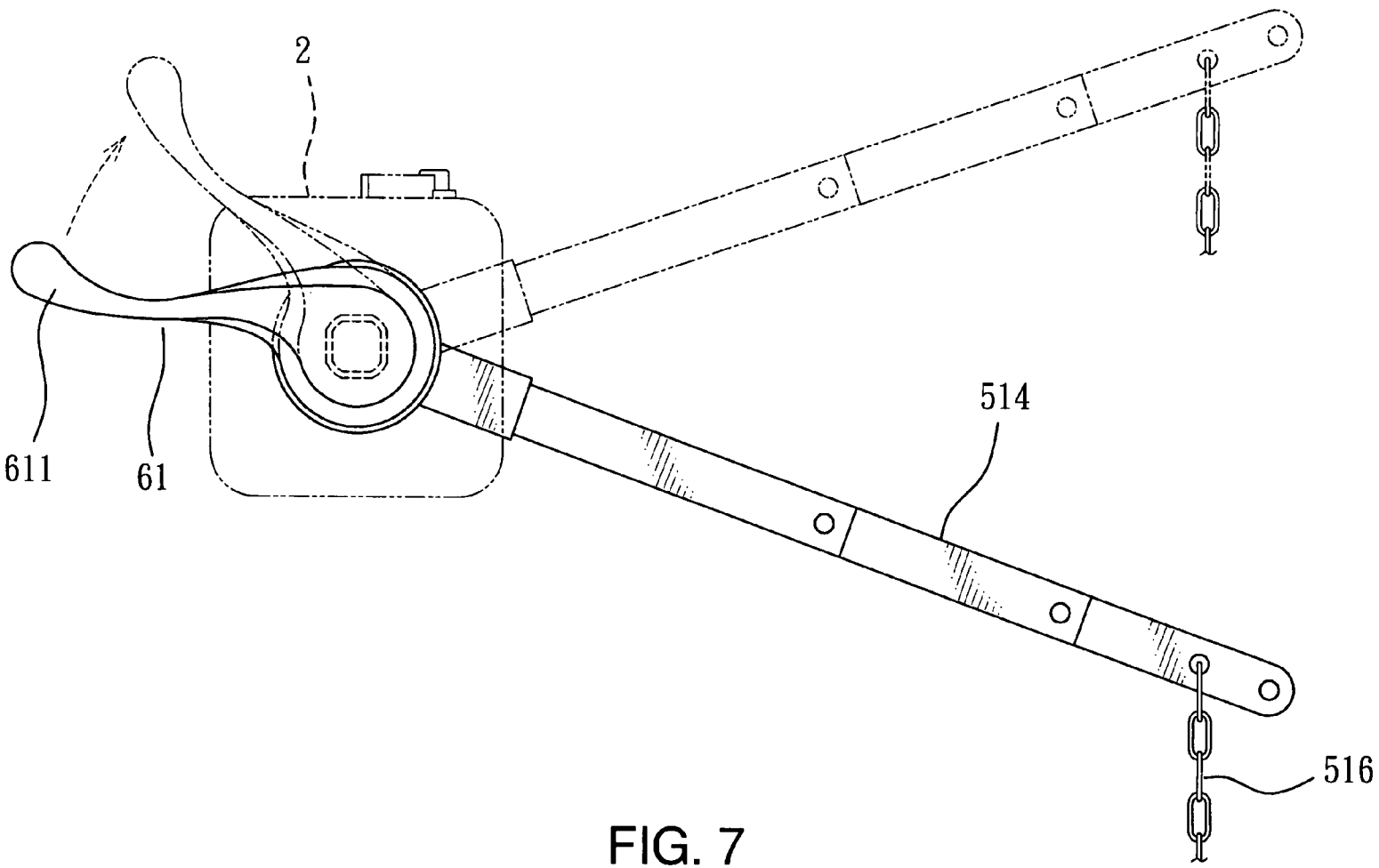
FIG. 7 is a schematic representation of urine-flushing operation according to the present invention.
Figure 8:
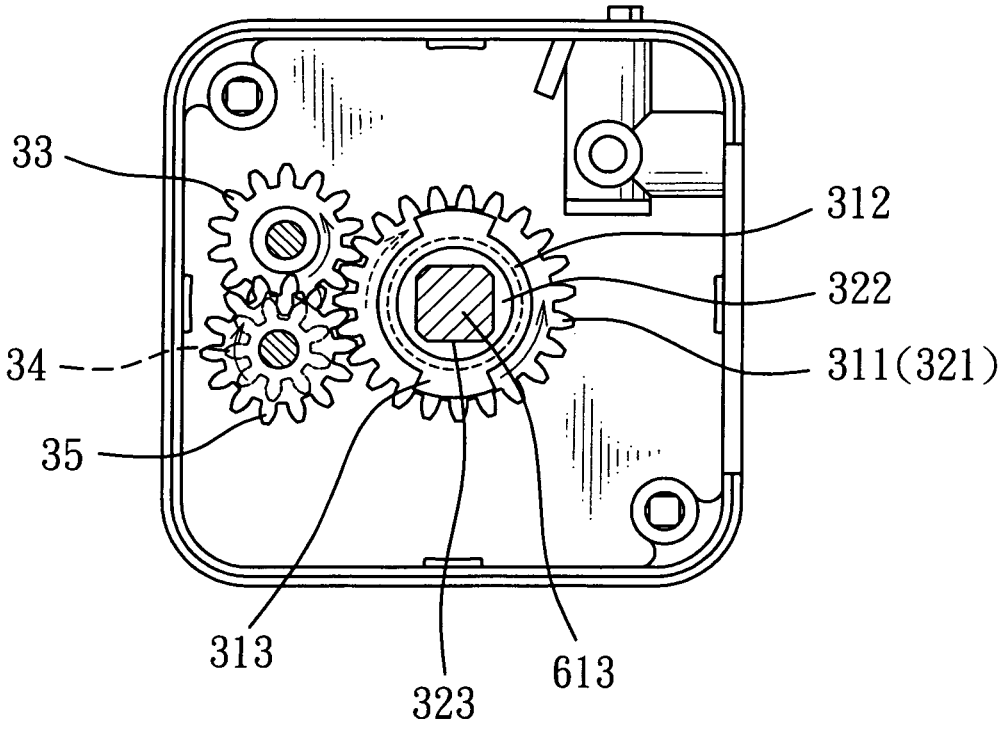
FIG. 8 is a schematic representation of the gear set actuation according to the present invention.

Referring to FIGS. 2, 5 and 6, the toilet flushing device A assembled by the foregoing assemblies can be installed to a toilet cistern 90 at a pivot hole 90 thereon; hang one end of the chain 516 on the hanging hole 515 of the connecting rod 514, and the other end of the chain 516 on a hanging part 932 of a valve body 93. One side of the valve body 93 suspends on a suspension part 911 of an overflow tube 91, and the valve body 93 covers a water outlet 94 of the flush valve 92.

With reference to FIGS. 7, 8, 9 and 10; when flushing urine, the user should lift the toilet flushing handle 61. As the toilet flushing handle 61 is lifted upwards, the rod body 612 links up with the driven seat 32, the second gear 321 of the driven seat 32 meshes with and actuates the third gear 33, the third gear 33 meshes with and actuates the fourth gear 34, the fourth gear 34 rotates and coaxially actuates the fifth gear 35, and the fifth gear 35 meshes with and actuates the first gear 311. By the foregoing method a decelerate effect is achieved and the third convex rib 313 fits with the first convex rib 517 in order to allow the rotation of the connecting rod head 51, thereby control the speed of the connecting rod 514 lifting the valve body 93 to prevent it from moving too fast, and hence the discharged water amount can be smaller.

Figure 11:
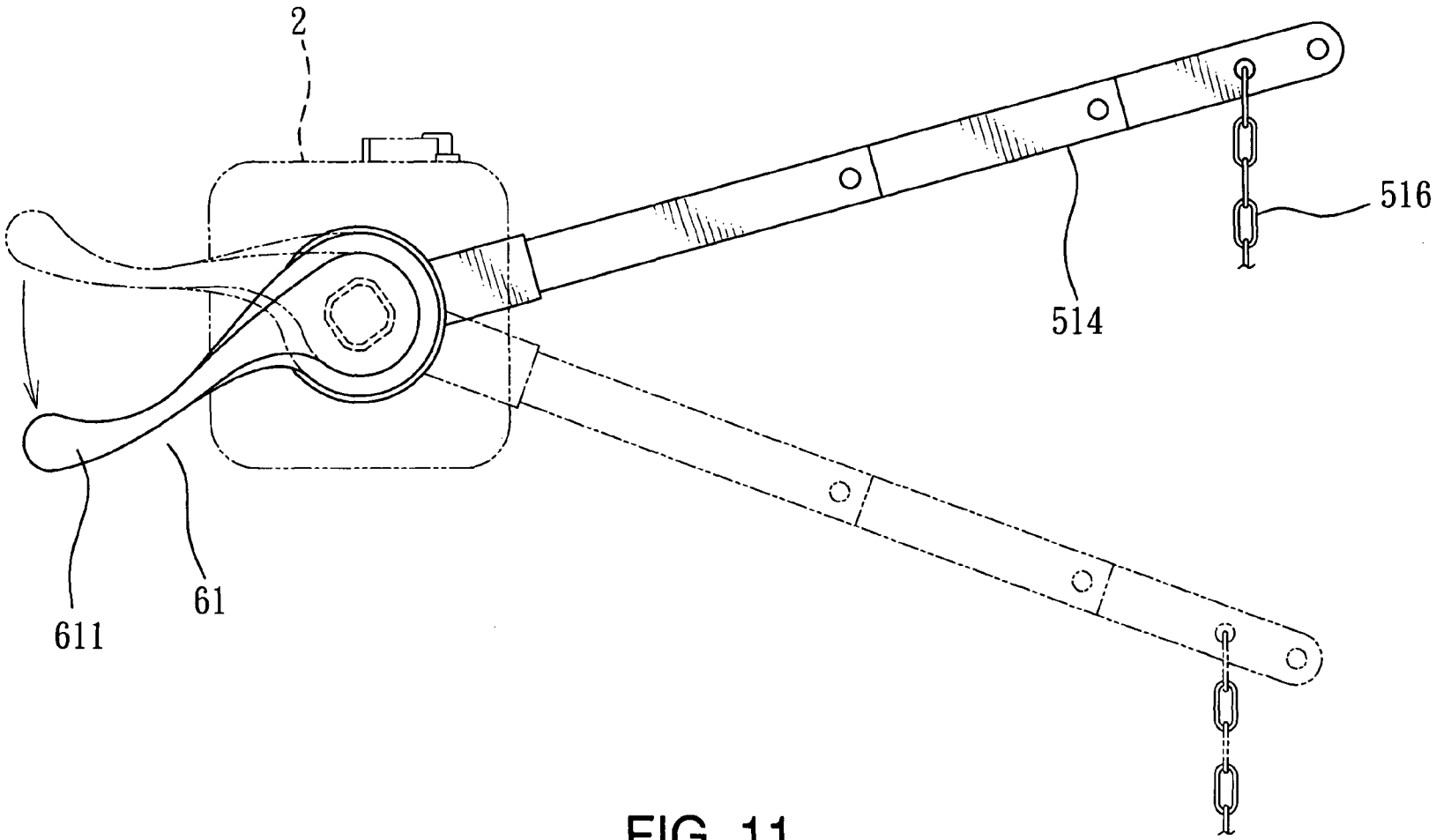
FIG. 11 is a schematic representation of stool-flushing operation according to the present invention.
Figure 12:
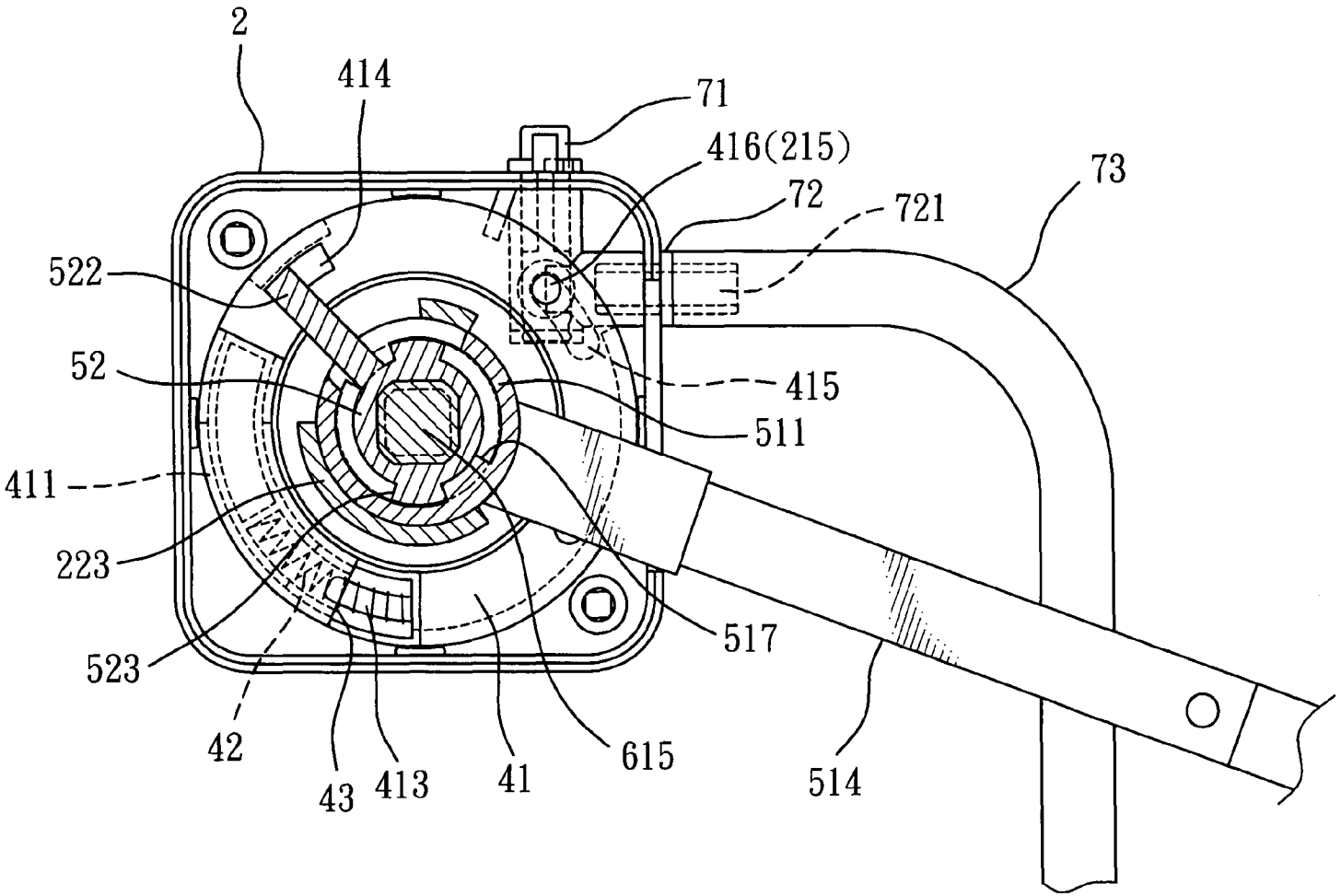
FIG. 12 is the first II-II sectional view according to the present invention.
Figure 13:
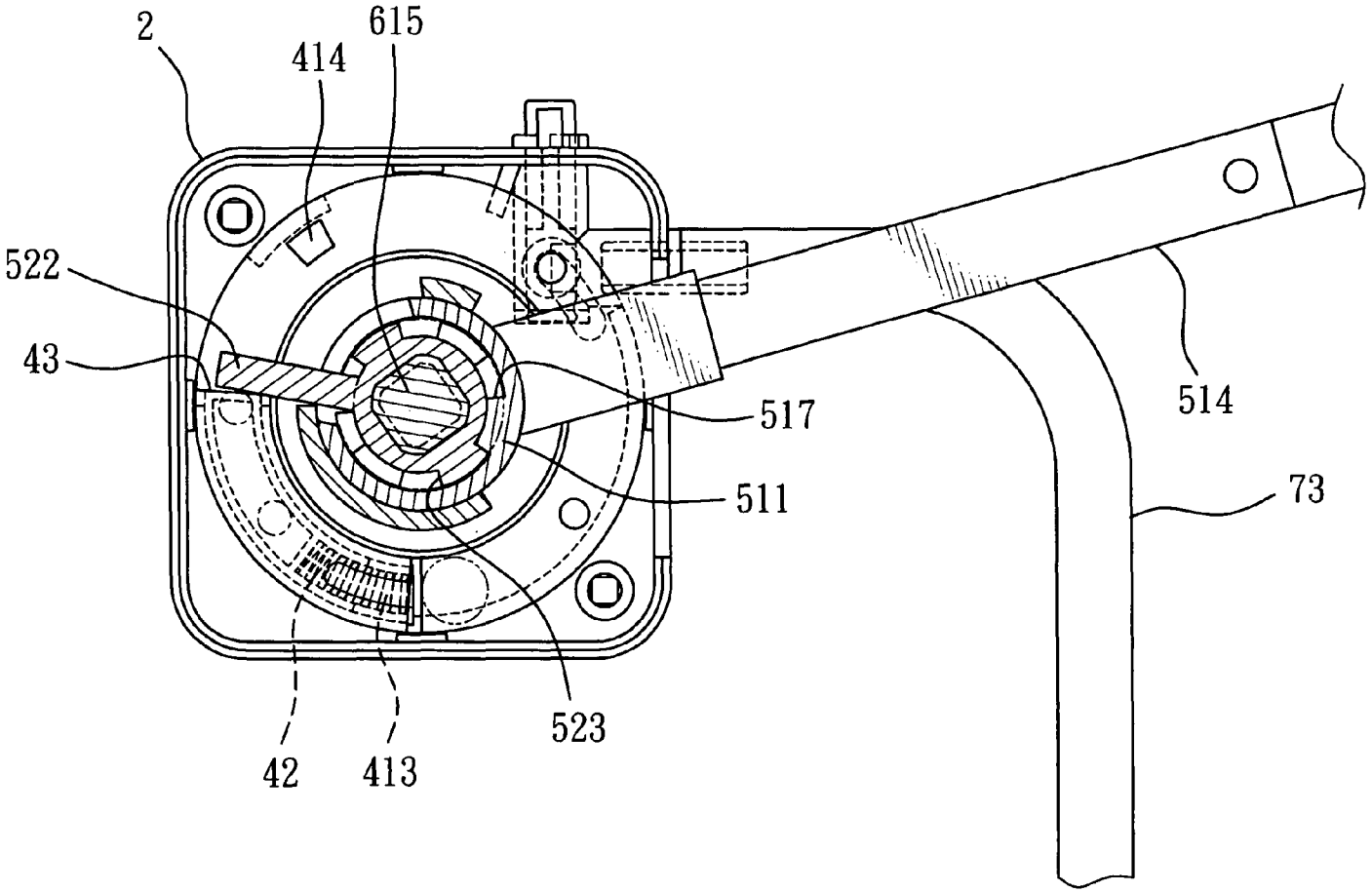
FIG. 13 is the second II-II sectional view according to the present invention.

With reference to FIGS. 11, 12 and 13; when flushing stool, the user should press the toilet flushing handle 61. As the toilet flushing handle 61 is pressed downwards, the rod body 612 of the toilet flushing handle 61 links up with the stop seat 52 and drives it to rotate, the second convex rib 523 of the stop seat 52 fits with the first convex rib 517 to rotate the connecting rod head 51 in order to allow the connecting rod 514 to lift the valve body 93. Since there is no buffer therebetween, the discharged water amount is larger. Further, during the handle-pressing process, the stop piece 522 pushes the arc-shaped pushing seat 43 to drive it to slide along the arc-shaped chamber 411 of the ring disk body 41; by the buffer of the spring 42, the lifting angle of the connecting rod 514 is bigger and thereby extends the water discharging time.

The ventilation set 7 of the toilet flushing device A adjusts the speed of the valve body 93 covering the flush valve 92; it controls the discharged water amount by controlling the amount of air flowing in and out. The covering is faster when the air amount is larger, and the discharged water amount is therefore smaller; and the covering is slower when the air amount is smaller, and the discharged water amount is therefore larger. On the contrary, as the air throughput amount is smaller or without any airflow, the covering time of the valve body 93 is longer since the covering relies on only the water, and the discharged water amount is therefore larger.

While the invention has been described with reference to a preferred embodiment thereof, it is to be understood that modifications or variations may be easily made without departing from the spirit of this invention, which is defined in the appended claims.

I claim:

1. A toilet flushing device comprising:

an outer casing comprised of a first casing body and a second casing body, wherein the first casing body has a receiving space and a first axle hole penetrates the center of the first casing body thereof; the second casing body is disposed of a second axle hole at the inner surface thereof;

a gear set comprising:

a drive seat having a seat body and a first gear disposed at the bottom thereof, wherein at least one third convex rib is disposed at peripheral edge of the seat body, and a housing aperture penetrates through center of the seat body;

a driven seat having a seat body, wherein a second gear disposed at the bottom of the seat body and a third axle hole that is polygonal is disposed at the center of the seat body;

a third gear meshing with the second gear;

a fourth gear meshing with the third gear;

a fifth gear coaxially linking up with the fourth gear and meshing with the first gear of the drive seat;

a ring disk set comprising a ring disk body, a spring and an arc-shaped pushing seat, wherein the ring disk body has a rounded hole at the center thereof and a plurality of supporting pieces are disposed along the periphery edge of the ring disk body; an arc-shaped chamber is provided at the top surface of the ring disk body, wherein a fixing column is convexly disposed at one side of the arc-shaped chamber and fits with one end of the spring; the arc-shaped pushing seat is disposed inside the arc-shaped chamber and pushed by the spring;

a connecting rod set comprising:

a connecting rod head comprising a connecting rod extends from periphery edge of a rounded main body, wherein the rounded main body comprises a fourth axle hole and a notch, and at least one first convex rib is disposed on the inner wall of the fourth axle hole;

a stop seat, wherein a stop piece and at least one second convex rib are disposed along periphery edge thereof;

a drive set comprising:

a toilet flushing handle having a handle body, wherein a rod body extends from one side of the handle body and a first joining section, a second joining section and an external thread section is disposed on the rod body;

a fixing axle cover having an axle hole penetrating the center thereof to allow insertion of the rod body, and peripheral edge of the fixing axle cover provides an external thread section;

a cistern fixing nut screw locked to the external thread section of the fixing axle cover; and a fixing rotate screw having an inner thread hole to allow screw locking with the external thread section of the rod body.

2. The toilet flushing device as defined in claim 1, wherein the outer casing further comprises a ventilation set; the ventilation set comprises an air cell disposed in the first casing body, a control valve, a connecting base and an air duct.

3. The toilet flushing device as defined in claim 1, wherein at least one arc-shaped retaining wall is disposed to surround peripheral edge of the second axle hole.

4. The toilet flushing device as defined in claim 1, wherein peripheral edge of one lateral surface of the second casing body is disposed of a notch.

5. The toilet flushing device as defined in claim 1, wherein an arc-shaped groove having an air hole is disposed at bottom lateral surface of the ring disk body.

6. The toilet flushing device as defined in claim 1, wherein the stop seat has a polygon hole.

* * * * *